US007201089B2

(12) United States Patent
Richter

(10) Patent No.: US 7,201,089 B2
(45) Date of Patent: Apr. 10, 2007

(54) FEEDER, GATHERER-STITCHER AND METHOD FOR INDEX PUNCHING

(75) Inventor: Lutz Richter, Schkeuditz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 912 days.

(21) Appl. No.: 10/267,334

(22) Filed: Oct. 9, 2002

(65) Prior Publication Data

US 2003/0066399 A1 Apr. 10, 2003

(30) Foreign Application Priority Data

Oct. 9, 2001 (DE) ..... 101 49 781

(51) Int. Cl.
*B26D 1/00* (2006.01)
*B42B 2/00* (2006.01)

(52) U.S. Cl. ..... 83/13; 83/90; 83/92.1; 83/917; 83/934; 217/52.17; 217/52.29; 412/16; 412/35

(58) Field of Classification Search ..... 412/16, 412/35, 8, 18, 25; 270/21.1, 51, 52.09, 37, 270/54, 53, 86, 52.17, 52.29, 66, 52.9, 83; 83/13, 934, 90, 91, 92, 29, 917, 92.1; 198/644
See application file for complete search history.

(56) References Cited

U.S. PATENT DOCUMENTS 2,390,901 A 12/1945 Schramm
2,914,318 A * 11/1959 McGarvey et al. ..... 270/32
3,146,651 A * 9/1964 Busk ..... 83/262
3,293,996 A * 12/1966 Luning ..... 493/333
3,438,622 A * 4/1969 Laschewski ..... 270/45
4,072,076 A * 2/1978 Miles ..... 83/300
4,076,232 A * 2/1978 Kistner et al. ..... 270/52.14
4,085,927 A * 4/1978 Muller ..... 270/52.29
4,466,603 A 8/1984 Schnell
4,576,369 A * 3/1986 Flensburg et al. ..... 270/52.17
4,715,758 A * 12/1987 Stobb ..... 412/8
5,158,273 A * 10/1992 Wagner ..... 270/52.17
5,309,804 A * 5/1994 Norris et al. ..... 83/37
5,492,315 A * 2/1996 Maruyama et al. ..... 270/58.32
5,921,752 A * 7/1999 Sinke et al. ..... 416/16
6,308,945 B1 * 10/2001 Sagesser ..... 270/52.27
6,572,093 B1 * 6/2003 Scholta ..... 270/52.17
6,647,849 B2 * 11/2003 Jones ..... 83/698.42
2003/0214092 A1 * 11/2003 Horii et al. ..... 270/52.18
2005/0166735 A1 * 8/2005 Alon et al. ..... 83/468.7

FOREIGN PATENT DOCUMENTS

DE 2 120 168 11/1972
DE 29 42 243 A1 4/1981

(Continued)

*Primary Examiner*—Boyer D. Ashley
*Assistant Examiner*—Ghassem Alie
(74) *Attorney, Agent, or Firm*—Laurence A. Greenberg; Werner H. Stemer; Ralph E. Locher

(57) ABSTRACT

A feeder for feeding flat products to a conveyor device includes a magazine for storing the products, a separating device for separating the products from the magazine and a device for producing an index in the products. A gatherer-stitcher includes a plurality of the feeders. A method is provided for producing an index cut in a product being fed.

11 Claims, 2 Drawing Sheets

FOREIGN PATENT DOCUMENTS

| | | |
|---|---|---|
| DE | 197 38 920 C2 | 3/1999 |
| DE | 199 00 149 A1 | 7/2000 |
| EP | 1 074 496 A1 | 2/2001 |
| GB | 2 064 489 A | 6/1981 |
| GB | 2 111 026 A | 6/1983 |

* cited by examiner

FEEDER, GATHERER-STITCHER AND METHOD FOR INDEX PUNCHING

BACKGROUND OF THE INVENTION

Field of the Invention

The invention relates to a feeder for feeding flat products, in particular paper sheets or signatures, to a conveyor device having a magazine for storing the products and a separating device for separating the products from the magazine. The invention also relates to a gatherer-stitcher and a method for index punching.

Gatherer-stitchers are paper processing machines which produce a product from a plurality of folded sheets, the individual folded sheets being connected to one another so that a final product is produced. The final products produced are multi-page printed products, such as magazines, brochures or the like. Gatherer-stitchers of this type normally have a plurality of feeders which feed the individual folded sheets to a gathering chain, whereon the different folded sheets are collected in groups so that the desired final product is produced. The groups of folded sheets hanging on the gathering chain are usually fed to a stapling station which has one or more stapling heads. In the stapling station, the folded products are connected at the spines thereof by wire staples.

After the stapling, the groups of folded sheets connected to one another in this manner are fed to a trimmer, which ensures a marginal trimming of the stapled products and then feeds the latter to a delivery.

In many printed products, such as pocket diaries, address books, prospectuses, weekly or monthly magazines and here, in particular, program periodicals, for example, it is desirable and to some extent already usual to provide these products with so-called thumb indexes. The thumb indexes permit the products to be opened quickly at a specific page position. The production of such thumb indexes is very complicated, however, there being at least approximately three different possible ways of introducing the indexes into the products. In a first method, the thumb index is introduced into a finally bound printed product. A method of this type is disclosed by U.S. Pat. No. 2,620,874, for example, but this method is particularly complicated because, in a separate operation, each individual product, i.e., for example, each individual pocket diary, address book or the like, has to be opened at the desired page position and the thumb index has to be punched in.

A further method is disclosed, for example, by German Published, Non-Prosecuted, Patent Application 21 20 168. In this regard, the thumb index is produced by so-called index punching, which is performed as a continuous procedure on an as yet uncut paper web, the punch being introduced during the course of the production of the product. In this regard, it is necessary for the device which is used for punching to be positioned precisely in terms of length and position in order to obtain satisfactory indexes. However, this method restricts the variability and the number of pages and, furthermore, requires the product to be printed completely in succession on the web.

In a further method, which is disclosed by the published European Patent Application EP 1 074 496 A1, for example, the punching of a thumb index is performed within the gatherer-stitcher. In this regard, a folded product fed to the gatherer-stitcher is lifted at a sheet part in the vicinity of the gathering chain and guided into the punching unit. The introduction of a thumb index in accordance with this device therefore requires that a specific index punching unit with an appertaining sheet opening device be provided downstream from each sheet feeding station. This gives rise, on the one hand, to considerable costs and, on the other hand, lengthens the gatherer-stitcher considerably, which immediately leads to an increase in the susceptibility of the overall gatherer-stitcher system to faults and disruptions. A particular problem with this embodiment is that the index punching on both marginal edges of a sheet which lies rather loosely on the gathering chain can take place only when both pages are lifted and the punching is carried out in parallel.

SUMMARY OF THE INVENTION

It is accordingly an object of the invention to provide a feeder, a gatherer-stitcher and a method for index punching, which overcome the hereinafore-mentioned disadvantages of the heretofore-known devices and methods of this general type and with which a reliable operating process may be performed in the gatherer-stitcher, while simultaneously providing assurance that the products will be produced cost-effectively.

With the foregoing and other objects in view, there is provided, in accordance with the invention, a feeder for feeding flat products, especially paper sheets or signatures, to a conveyor device, comprising a magazine for storing the products. A separating device separates the products from the magazine and a device produces an index in the products.

In accordance with another feature of the invention, the separating device includes a separating drum having marginal regions. The feeder further includes a cutting device positionable along an axis of the separating drum.

In accordance with a further feature of the invention, the feeder further comprises a creasing disk assigned to the separating drum. The cutting device includes respective cutting disks disposed on both sides of the creasing disk.

In accordance with an added feature of the invention, the cutting device has knife disks cooperating with the cutting disks.

In accordance with an additional feature of the invention, the creasing disk is disposed downstream from the knife disks in paper travel direction.

In accordance with yet another feature of the invention, the feeder is constructed as a cover folding feeder.

With the objects of the invention in view, there is also provided a gatherer-stitcher for collating printed products, comprising a gathering chain, and a plurality of feeders for feeding flat products to the gathering chain. The feeders, respectively, having a magazine for storing the products. A separating device separates the products from the magazine. At least one of the feeders has a device for producing an index in the products.

In accordance with yet an added feature of the invention, the separating device has a separating drum which, relative to both marginal regions thereof, has a cutting device positionable along an axis of the separating drum.

In accordance with yet an additional feature of the invention, the gatherer-stitcher further comprises a device for producing a crease, which is assigned to the at least one feeder.

In accordance with still another feature of the invention, the device for producing a crease is a creasing disk.

With the objects of the invention in view, there is additionally provided a method for producing an index cut in a product being transported by a separating device in a feeder from a magazine in the feeder to a conveyor device. The method comprises providing a device in the feeder for producing the index in the product.

Therefore, according to the invention, the feeder for feeding flat products, in particular for feeding paper sheets or signatures, is already provided with a device for producing an index in the products. For each individual feeder, the index-cutting and index-punching devices, respectively, are able to be provided in such a way that the fed product does not have to be opened up to introduce the index. Setting the size of the index to be punched takes place directly on each feeder and is the same for all the products transported from this feeder. This has the advantage in particular that it is possible to provide different index sizes on either side of the products in a relatively simple manner.

If the feeder that is used is a so-called cover folding feeder, the index punching device according to the invention may then be realized in a particularly advantageous manner. This is because, in this feeder type, the magazine that is provided is typically filled with unfolded paper sheets. These unfolded paper sheets lie flat in the magazine and, after being separated, are fed to an index-punching and cutting device, respectively, which introduces the required page index into the product, in particular by cutting it in. At the same time, it is possible to produce a folded edge in the product by providing a creasing device, for example a creasing disk, which folds the product at the desired location. The product folded in this way can then be fed to the paper transport device, for example the gatherer-stitcher chain, and in the process added to the products lying on the gathering chain and, if appropriate, provided with index punching. Prefolded signatures may, however, also be fed to a gatherer-stitcher on such a cover folding feeder, which increases the possible uses even further. Due to the further transport thereof on the gathering chain, a final product with index punching can therefore be produced in a simple way.

Other features which are considered as characteristic for the invention are set forth in the appended claims.

Although the invention is illustrated and described herein as embodied in a feeder, a gatherer-stitcher and a method for index punching, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
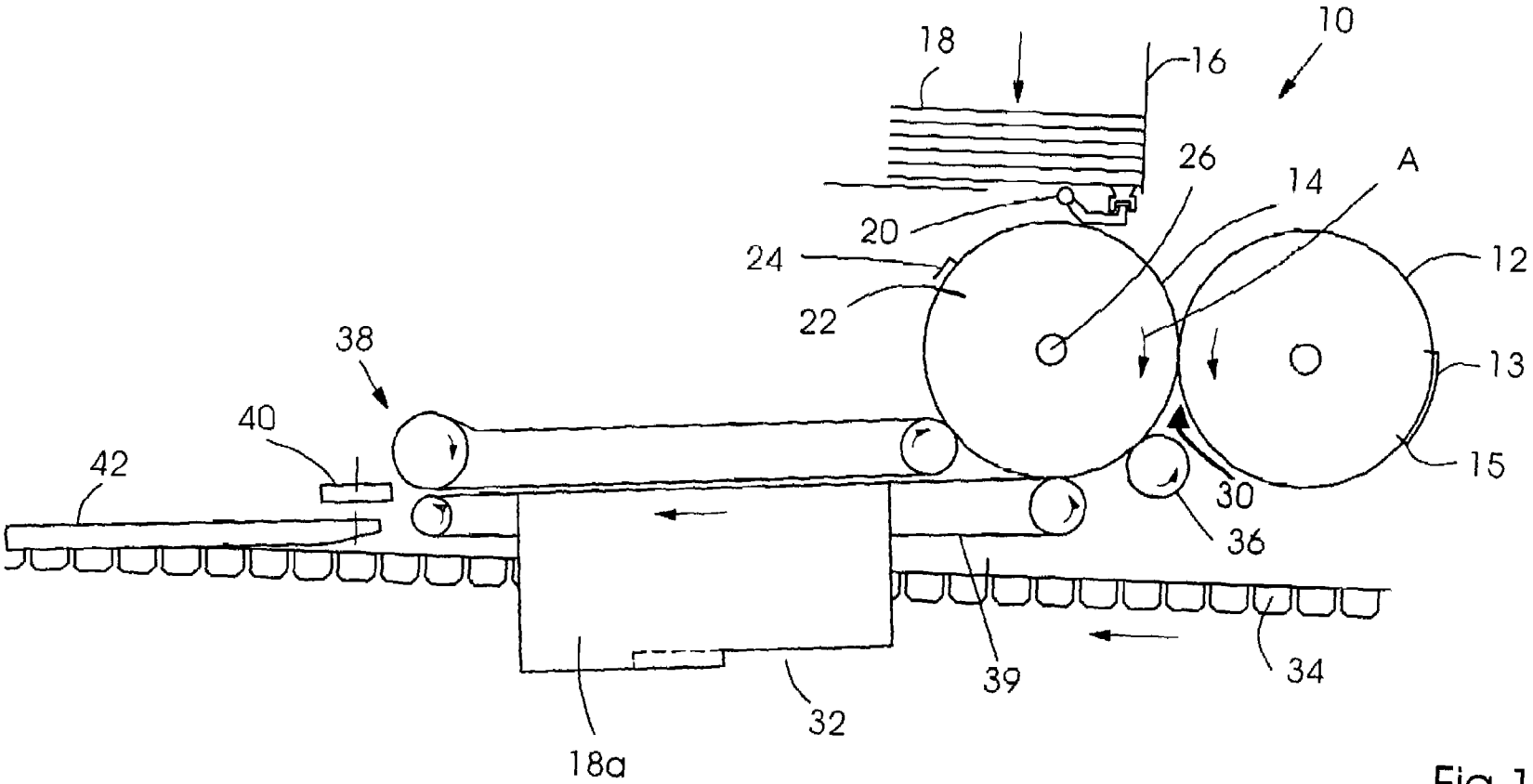
FIG. 1 is a diagrammatic, side-elevational view of a feeder with a device for producing an index.

Referring now to the figures of the drawings in detail and first, particularly, to FIG. 1 thereof, there is seen a diagrammatically illustrated cover folding feeder 10 according to the invention, which has a device for producing an index. This feeder is provided with a magazine 16 wherein flat products 18, in particular paper sheets, open sheets, folded sheets or signatures, are stored, i.e., thus kept in stock. With the aid of a singling or separating device which, in the case at hand, comprises a suction rod 20 and a singling or separating drum 22, the lowermost of the flat products 18 is fed to a gripper 24 which is coupled to the singling or separating drum 22. The singling or separating drum 22 with the gripper 24 accordingly pulls the separated flat product 18 from the pile thereof and guides it along the direction of the arrow A on the surface of the singling or separating drum 22.

Laterally of the singling or separating drum 22, on at least one side but preferably on both sides thereof, a cutting disk 14 is disposed. The cutting disk 14 is positionable along the axis 26 of the cylinder, so that it can be mounted at different spaced distances relative to the singling or separating drum 22. Assurance is thereby provided that the width of the marginal trim is adjustable. Furthermore, a knife disk 12 is provided for each cutting disk 14, the knife disk 12 and the cutting disk 14 together forming a cutting device 30. In order to introduce an index cut, i.e., thus a marginal cut, into one of the flat products 18, a knife or blade 13 is disposed on the knife disk 12. The flat products 18 are conveyed between the cutting disks 14 and the knife disk 12 and, simultaneously, when the knife 13 strikes the flat product 18, an index cut is made in the marginal region of the flat product 18. In addition to the knife 13, which is constructed as a revolving knife or blade, the knife disk 12 also has a vertical knife 15 oriented axially parallel with the axis of rotation of the cutting disk 14. The position of the vertical knife 15 ultimately determines the length of the marginal cut 32 which is introduced into the trimmed flat product 18*a*.

The length of the marginal cut 32 may be adjusted by a radial adjustment of the knife disk 12 and of the position of the vertical knife 15.

The trimmed product 18*a* is then fed to a conveyor device, in particular a gatherer-stitcher, whereon folded sheets are transported in a hanging manner. If a so-called cover folding feeder is used as the feeder, a device is also provided which folds the intrinsically flat sheet or so-called open sheet or broadsheet, as it is conveyed, and feeds the thus folded sheet to the conveyor device 34 as a folded product. For this purpose, a creasing disk 36 can be provided, which is assigned to the singling or separating cylinder 22. The creasing disk 36 produces a nominal fold in the flat products, along which the free sheet is folded with the aid of the folding device 38. Furthermore, folding rollers 40 can be provided, to which the flat product is transported with the aid of folding belts 39 which are arranged in the folding device 38. The folding rollers 40 fold the sheets in the travel direction thereof, and transfer them, for example, over a print run blade 42, to the conveyor device 34. If a creasing disk 36 should be provided, it is positioned so that the crease follows along a line which is later provided for the fold. Usually, the knife disks 12 and the cutting disks 14 are, in this regard, positioned so that they, respectively, lie on opposite sides of the crease line. They typically have the same spacing from the crease line, which ultimately calls for the knife disks 12 and the cutting disks 14 to be arranged on both sides at the same distance from the creasing disk 36.

With the index punching unit according to the invention, it is then possible to perform the index punching within a folding feeder of a gatherer-stitcher. Thus, no additional units and no additional operations are required for index punching. Furthermore, the cover folding feeder according to the invention can be erected in a space-saving manner. Additionally, high index cutting accuracy can be achieved, because the sheet is clamped firmly and guided within the feeder.

Due to the adjustability of the knife disk and the cutting disks according to the invention, both in the position thereof along the axis 26 of the cylinder and also as a result of radial adjustment of the knife disks 12, it is possible, intrinsically, to produce any desired index length 32. In addition, different index lengths and widths can be set on the two sides. Furthermore, index cutting on only one side is readily possible.

The index punching device according to the invention, moreover, offers the advantage that uncomplicated disposal of the index sections can be performed, because the knife disks lie to the righthand and lefthand sides of the gathering chain in the sheet revolving direction and can therefore be removed readily by suction.

Figure 2:
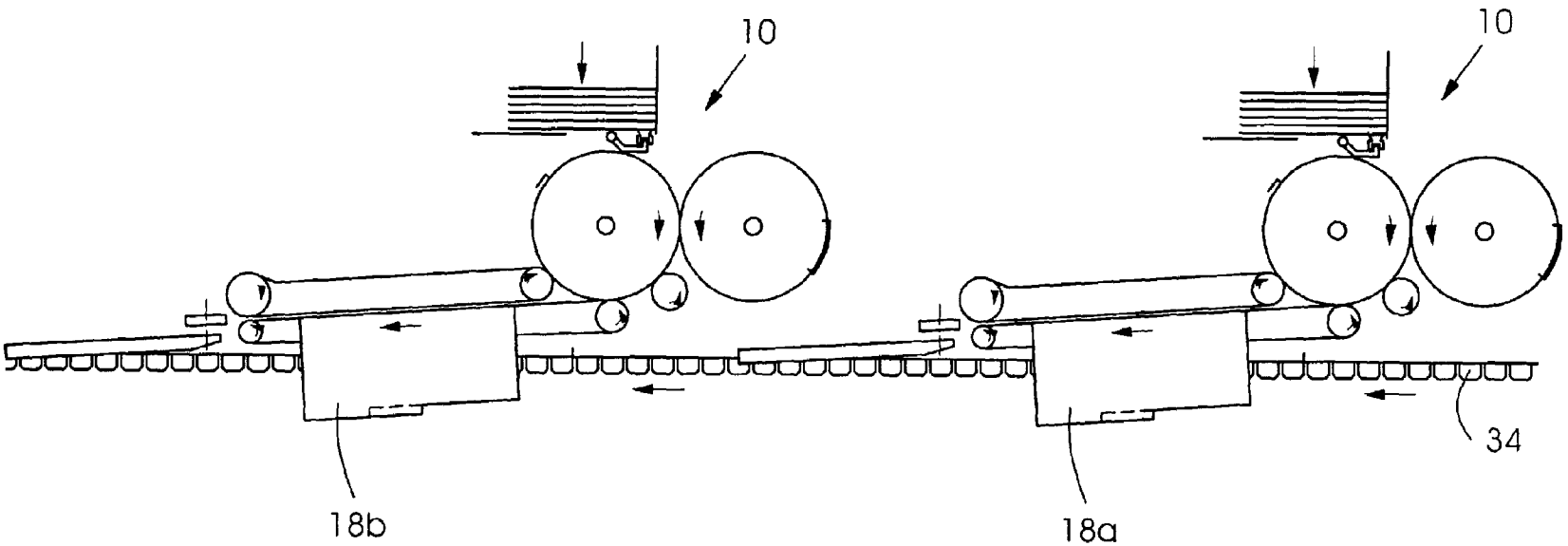
FIG. 2 is a side-elevational view of FIG. 1, on a reduced scale, but showing a gathering chain with a plurality of feeders for producing an index.

FIG. 2 shows in a diagrammatic side elevational view that the index punching unit according to the invention can also be provided repeatedly along a gathering chain 34. Therefore, even products 18*a*, 18*b* with introduced index marginal cuts 32 can be collected conveniently above one another on the gathering chain 34, so that it is thereby possible to collect above one another the desired folded sheets provided with an index, and subsequently to feed them to a binding process, for example at a stapling device. Thus, printed products which are provided with an index for facilitating the ability to locate specific positions or pages in the printed product may be produced in a relatively simple manner.

I claim:

1. A feeder for feeding flat products to a conveyor device, comprising:

a magazine for storing the products;

a seperating drum for seperating the products from the magazine; and a device positioned along an axis of said seperating drum for producing an index in the products.

2. The feeder according to claim 1, wherein said seperating drum having marginal regions and a cutting device is to be positioned along said axis of said separating drum.

3. The feeder according to claim 2, further comprising a creasing disk assigned to said separating drum, said cutting device including a respective cutting disk disposed on at least one side of the creasing disk.

4. The feeder according to claim 3, wherein said cutting device has a knife disk cooperating with said cutting disk.

5. The feeder according to claim 4, wherein said creasing disk is disposed downstream from said knife disk in paper travel direction.

6. The feeder according to claim 1, wherein the feeder is a cover folding feeder.

7. A gatherer-stitcher for collating printed products, comprising a gathering chain, and a plurality of feeders for feeding flat products to said gathering chain, said feeders each respectively having a magazine for storing the products and a separating device for separating the products from the magazine, at least one of said feeders having a device for producing an index in the products.

8. The gatherer-stitcher according to claim 7, wherein said separating device has a separating drum with an axis, marginal regions, and a cutting device to be positioned along said axis of said separating drum relative to both of said marginal regions.

9. The gatherer-stitcher according to claim 7, further comprising a device for producing a crease, said device for producing a crease being associated with said at least one feeder.

10. The gatherer-stitcher according to claim 7, wherein said device for producing a crease is a creasing disk.

11. A method for producing an index cut in a product being transported by a separating device in a feeder from a magazine in the feeder to a conveyor device, the method which comprises producing the index in the product with a device in the feeder.

* * * * *